US010603709B2

(12) United States Patent
Kohno et al.

(10) Patent No.: US 10,603,709 B2
(45) **Date of Patent: *Mar. 31, 2020**

(54) DIE CUSHION DEVICE

(71) Applicant: AIDA ENGINEERING, LTD., Sagamihara-shi, Kanagawa (JP)

(72) Inventors: Yasuyuki Kohno, Sagamihara (JP); Tadahiro Kondo, Sagamihara (JP)

(73) Assignee: AIDA ENGINEERING, LTD., Kanagawa (JP)

( * ) Notice: Subject to any disclaimer, the term of this patent is extended or adjusted under 35 U.S.C. 154(b) by 253 days.

This patent is subject to a terminal disclaimer.

(21) Appl. No.: 15/727,863

(22) Filed: Oct. 9, 2017

(65) Prior Publication Data

US 2018/0036783 A1 Feb. 8, 2018

Related U.S. Application Data

(63) Continuation of application No. 14/704,469, filed on May 5, 2015, now Pat. No. 9,782,816.

(30) Foreign Application Priority Data

Jun. 11, 2014 (JP) ..... 2014-120394

(51) Int. Cl.
*B21D 24/14* (2006.01)
*F15B 1/02* (2006.01)
(Continued)

(52) U.S. Cl.
CPC ..... *B21D 24/14* (2013.01); *B21D 24/02* (2013.01); *F15B 1/024* (2013.01); *F15B 21/005* (2013.01);
(Continued)

(58) Field of Classification Search
CPC .. B30B 1/32; B30B 1/323; B30B 1/34; B30B 15/0064; B30B 15/061; B30B 15/14;
(Continued)

(56) References Cited

U.S. PATENT DOCUMENTS 4,593,547 A 6/1986 Heiberger
4,669,298 A 6/1987 Kono et al.
(Continued)

FOREIGN PATENT DOCUMENTS

CN 2694019 Y 4/2005
DE 102010036204 A1 * 3/2012 ..... B22D 17/266
(Continued)

OTHER PUBLICATIONS

Non-final Office Action issued in related U.S. Appl. No. 14/704,469, dated Jun. 22, 2016.
(Continued)

*Primary Examiner* — Adam J Eiseman
*Assistant Examiner* — Stephen Floyd London
(74) *Attorney, Agent, or Firm* — McDermott Will & Emery LLP

(57) ABSTRACT

There is provided a die cushion device that includes a cushion pad, a hydraulic cylinder configured to lift the cushion pad, and a hydraulic closed circuit connected to a die cushion pressure creation chamber of the hydraulic cylinder. The hydraulic closed circuit includes a pilot drive type logic valve that is operable as a main relief valve at the time of the die cushion operation, and a pilot relief valve configured to create pilot pressure for controlling the logic valve. Hydraulic oil is filled in the hydraulic closed circuit, in a pressurized manner, and the hydraulic oil in the hydraulic closed circuit is pressurized by only die cushion force applied from the cushion pad through the hydraulic cylinder, in one cycle period of the cushion pad.

16 Claims, 8 Drawing Sheets

(51) Int. Cl.
*B21D 24/02* (2006.01)
*F15B 21/00* (2006.01)

(52) U.S. Cl.
CPC ..... *F15B 2211/212* (2013.01); *F15B 2211/88* (2013.01)

(58) Field of Classification Search
CPC ..... B21D 24/02; B21D 26/02; B21D 26/021; B21D 26/027
See application file for complete search history.

(56) References Cited

U.S. PATENT DOCUMENTS

| | | | | |
|---|---|---|---|---|
| 5,638,748 | A | 6/1997 | Daniel | |
| 5,644,915 | A | 7/1997 | Dressing et al. | |
| 5,701,778 | A | 12/1997 | Kirii | |
| 5,865,088 | A * | 2/1999 | Nakabayashi | B30B 1/32 91/509 |
| 6,205,828 | B1 | 3/2001 | Nagao et al. | |
| 8,850,865 | B2 | 10/2014 | Miyasaka et al. | |
| 2006/0108185 | A1 | 5/2006 | Bitter | |
| 2006/0254337 | A1 | 11/2006 | Arns et al. | |
| 2010/0043519 | A1 * | 2/2010 | Schaltegger | B21D 24/14 72/352 |
| 2011/0180166 | A1 * | 7/2011 | Nakamura | B22D 17/32 137/597 |
| 2011/0265544 | A1 * | 11/2011 | Micklisch | B21D 24/14 72/351 |

FOREIGN PATENT DOCUMENTS

| | | | | |
|---|---|---|---|---|
| JP | S62124100 | A * | 6/1987 | B21D 24/02 |
| JP | H07806618 | A * | 3/1995 | |
| JP | H0747196 | Y2 * | 11/1995 | |
| JP | 2001-79694 | A | 3/2001 | |
| JP | 4761410 | B2 * | 8/2011 | |
| JP | 5060423 | B2 * | 10/2012 | |

OTHER PUBLICATIONS

Final Office Action issued in related U.S. Appl. No. 14/704,469, dated Nov. 28, 2016.
Notice of Allowance issued in related U.S. Appl. No. 14/704,469, dated Jun. 1, 2017.

* cited by examiner

DIE CUSHION DEVICE

CROSS-REFERENCE TO RELATED APPLICATIONS

This application is a continuation of U.S. patent application Ser. No. 14/704,469, filed May 5, 2015, now issued U.S. Pat. No. 9,782,816, which claims priority to Japanese Patent Application No. 2014-120394 filed Jun. 11, 2014, the subject matter of which is incorporated herein by reference in entirety.

BACKGROUND OF THE INVENTION

Field of the Invention

The present invention relates to a die cushion device, and more particularly, to an inexpensive and functionally efficient die cushion device.

Description of the Related Art

Heretofore, there is proposed a die cushion device configured to create die cushion pressure by using a balance piston type relief valve (Japanese Patent Application Laid-Open No. 2001-079694, hereinafter referred to as PTL 1).

The die cushion device described in PTL 1 includes, as a device that creates hydraulic pressure to be supplied to a cushion cylinder, a first hydraulic creation mechanism that creates low hydraulic pressure, and a second hydraulic creation mechanism that creates high hydraulic pressure. In the die cushion device, the first hydraulic creation mechanism first applies low hydraulic pressure to a cushion cylinder after molding for each molding cycle to extend the cushion cylinder, and while the cushion cylinder is positioned near a top dead center, the second hydraulic creation mechanism applies high hydraulic pressure to the cushion cylinder to increase the cushion pressure in advance. In addition, when die cushion is operated, hydraulic oil in the cushion cylinder is returned to a sealed oil tank through a pilot check valve to which pilot pressure (high hydraulic pressure) is applied and a pilot relief valve to which compressed air is applied.

Here, the first hydraulic creation mechanism is composed of the sealed oil tank, a compressed air supply source that supplies compressed air at low pressure to the sealed oil tank, and the like, and the second hydraulic creation mechanism is composed of a hydraulic pump and an electric motor, which are continuously operated during operation of a press machine.

SUMMARY OF THE INVENTION

In the die cushion device described in PTL 1, when the first hydraulic creation mechanism (sealed oil tank) applies low hydraulic pressure to the cushion cylinder to extend the cushion cylinder, compressed air (0.5 MPa, for example) is supplied to the sealed oil tank from the compressed air supply source, and the hydraulic pump and the electric motor constituting the second hydraulic creation mechanism are continuously operated during operation of the press machine. In addition, high hydraulic pressure (20 to 30 MPa, for example) created by the second hydraulic creation mechanism is accumulated in an accumulator to be applied to the cushion cylinder while the cushion cylinder is positioned near the top dead center.

That is, since the die cushion device described in PTL 1 requires a compressed air supply source for creating low hydraulic pressure and a hydraulic pump and an electric motor for creating high hydraulic pressure, there is a problem in which the device becomes complicated and expensive. In addition, there is a problem of requiring power costs (running costs) of driving the compressed air supply source and the electric motor for each cycle of die cushion operation.

The present invention has been made in light of the above-mentioned circumstances, and an object of the present invention is to provide an inexpensive and functionally efficient die cushion device that does not require a device consuming electric power such as a hydraulic pump.

In order to achieve the object above, a die cushion device in accordance with one aspect of the present invention includes: a cushion pad; a fluid-pressure cylinder configured to lift the cushion pad; and a fluid-pressure closed circuit that includes a die cushion pressure creation line connected to a die cushion pressure creation chamber of the fluid-pressure cylinder, a system pressure line to which an accumulator is connected, the accumulator being configured to accumulate hydraulic fluid at low system pressure capable of knockout operation, a pilot drive type logic valve that is provided between the die cushion pressure creation line and the system pressure line, and that is operable as a main relief valve at a time of die cushion operation, and a pilot relief valve that is provided between the die cushion pressure creation line and the system pressure line, and that creates pilot pressure for controlling the logic valve. In the die cushion device, hydraulic fluid is filled in the fluid-pressure closed circuit in a pressurized manner, and a fluid-pressure pump configured to pressurize and feed the hydraulic fluid is not provided, so that it is possible to pressurize the hydraulic fluid in the fluid-pressure closed circuit in one cycle period of the cushion pad, including the die cushion operation and the knockout operation, by using only die cushion force applied from the cushion pad through the fluid-pressure cylinder.

In accordance with the one aspect of the present invention, there is provided a fluid-pressure closed circuit including a pilot drive type (balance piston type) relief valve of combination of the logic valve and the pilot relief valve. In the fluid-pressure closed circuit, hydraulic fluid is filled in a pressurized manner, and the hydraulic fluid in the fluid-pressure closed circuit is pressurized in one cycle period of the cushion pad, including the die cushion operation and the knockout operation, by using only die cushion force applied from the cushion pad through the fluid-pressure cylinder, so that a fluid-pressure pump is not provided. At the time of the die cushion operation, the logic valve operates as a main relief valve to create die cushion pressure corresponding to the pilot pressure created by the pilot relief valve. In addition, rising (uplift) operation including the knockout operation of the cushion pad is performed by using hydraulic fluid at system pressure accumulated in the accumulator. In this manner, the hydraulic fluid is pressurized in one cycle period of the cushion pad by only die cushion force applied from the cushion pad through the fluid-pressure cylinder. As a result, no fluid-pressure pump is provided in the fluid-pressure closed circuit so that it is possible to save power costs.

In a die cushion device in accordance with another aspect of the present invention, there is provided a first solenoid valve that switches pressure to act on a pilot port of the logic valve to any one of the pilot pressure and the system pressure during one cycle period of the cushion pad. When the first solenoid valve switches so that the pilot pressure acts on the pilot port of the logic valve, it is possible to create die cushion pressure corresponding to the pilot pressure in the die cushion pressure creation line. In addition, when the first solenoid valve switches so that the system pressure acts on the pilot port of the logic valve, it is possible to reduce die cushion pressure created in the die cushion pressure creation line to the system pressure.

In a die cushion device in accordance with yet another aspect of the present invention, it is preferable that the first solenoid valve is a poppet type solenoid valve. This is because there is no leak of hydraulic fluid in the poppet type solenoid valve.

In a die cushion device in accordance with yet another aspect of the present invention, it is preferable to provide a second solenoid valve between the die cushion pressure creation line and the system pressure line. The second solenoid valve is controlled to enable locking operation and rising operation of the cushion pad at the bottom dead center.

In a die cushion device in accordance with yet another aspect of the present invention, it is preferable that the second solenoid valve is a poppet type solenoid valve. This is because there is no leak of hydraulic fluid in the poppet type solenoid valve.

In a die cushion device in accordance with yet another aspect of the present invention, there is provided a controller configured to control the first solenoid valve and the second solenoid valve. The controller controls the first solenoid valve so that the pilot pressure is applied to a pilot port of the logic valve during a descending period of the cushion pad, and controls the second solenoid valve so that the second solenoid valve is opened during a rising period of the cushion pad. Since the controller performs only a simple control of the first and second solenoid valves (since no special control device is required), a part of a controller, such as a programmable logic controller (PLC), of a press machine, and the like, is available for the controller to become inexpensive.

In a die cushion device in accordance with yet another aspect of the present invention, the first solenoid valve is controlled so as to apply the pilot pressure to the pilot port of the logic valve during a descending (lifting down) period of the cushion pad to enable die cushion pressure corresponding to the pilot pressure to be created in the die cushion pressure creation line, as well as to enable die cushion force to be created in the fluid-pressure cylinder during a descending period of the cushion pad. In addition, the second solenoid valve is opened at an appropriate timing after the die cushion operation to enable hydraulic fluid at the system pressure accumulated in the accumulator to be supplied to the fluid-pressure cylinder through the die cushion pressure creation line. As a result, it is possible to raise the cushion pad to a standby position.

In a die cushion device in accordance with yet another aspect of the present invention, it is preferable to provide a plurality of second solenoid valves in a line between the die cushion pressure creation line and the system pressure line in parallel, and preferable that the controller individually controls opening and closing of the plurality of the second solenoid valves during a rising period of the cushion pad to control a rising speed of the cushion pad. That is, the number of the plurality of second solenoid valves to be opened or closed is varied so that it is possible to vary a flow rate of hydraulic fluid to be supplied to the die cushion pressure creation line from the accumulator in a stepwise manner. As a result, it is possible to control the rising speed of the cushion pad.

In a die cushion device in accordance with yet another aspect of the present invention, it is preferable that the second solenoid valve is a proportional solenoid valve, and that the controller controls opening of the proportional solenoid valve during a rising period of the cushion pad to control a rising speed of the cushion pad. That is, the opening of the proportional solenoid valve is continuously varied so that it is possible to continuously vary the flow rate of hydraulic fluid to be supplied to the die cushion pressure creation line from the accumulator. As a result, it is possible to control the rising speed of the cushion pad.

In a die cushion device in accordance with yet another aspect of the present invention, it is preferable to provide a die cushion position detector configured to detect a position of the cushion pad, and preferable that the controller controls the second solenoid valve in accordance with a detection signal of a position of the cushion pad, detected by the die cushion position detector during a rising period of the cushion pad. That is, the second solenoid valve is controlled in accordance with the detection signal of a position of the cushion pad so that it is possible to vary the rising speed of the cushion pad as well as possible to stop the cushion pad at a desired standby position.

In a die cushion device in accordance with yet another aspect of the present invention, it is preferable to provide a die cushion pressure command unit that instructs die cushion pressure, a die cushion speed detector that detects a speed of the cushion pad, a solenoid proportion pilot relief valve serving as the pilot relief valve, and a die cushion pressure controller that controls the solenoid proportion pilot relief valve in accordance with a die cushion pressure command value commanded by the die cushion pressure command unit and a detection signal of a speed of the cushion pad, detected by the die cushion speed detector to control the die cushion pressure. Accordingly, it is possible to keep the die cushion pressure constant as well as possible to vary the die cushion pressure in accordance with a desired pattern.

In a die cushion device in accordance with yet another aspect of the present invention, it is preferable to provide a cooling device that cools the system pressure line, or the accumulator. Since the die cushion pressure is created by throttling a liquid current, energy consumed in the die cushion operation is converted into heat to raise temperature of the hydraulic fluid. Thus, it is preferable to provide the cooling device to reduce a rise in temperature of the hydraulic fluid.

In a die cushion device in accordance with yet another aspect of the present invention, it is preferable to mount a throttle valve, or a throttle valve and a coupler for feeding fluid and filling system pressure in the die cushion pressure creation line, the system pressure line, and a pilot pressure creation line in which the pilot relief valve is provided. This is because when hydraulic fluid is filled in a fluid-pressure closed circuit in a pressurized manner by an external feeding fluid device, the valve or the valve and the coupler serve as a filler port and an exhaust port for the hydraulic fluid.

In a die cushion device in accordance with yet another aspect of the present invention, there is accompanied a feeding fluid device that includes a tank that stores the hydraulic fluid, a discharge port through which the hydraulic fluid is fed into the fluid-pressure closed circuit, a return port through which the hydraulic fluid is returned form the fluid-pressure closed circuit, the return port being connected to the tank, and a fluid-pressure pump that supplies the hydraulic fluid from the tank to the fluid-pressure closed circuit through the discharge port. In the feeding fluid device, the fluid-pressure pump is driven only when the hydraulic fluid is filled in the fluid-pressure closed circuit in a pressurized manner. The feeding fluid device above is an external device that is attached to and detached from the die cushion device, and that is connected to be used only when the hydraulic fluid is filled in the fluid-pressure closed circuit in a pressurized manner. The feeding fluid device is not required to be accompanied for each of die cushion devices, but one feeding fluid device may be prepared for a plurality of controlled die cushion devices.

In a die cushion device in accordance with yet another aspect of the present invention, it is preferable to accompany the feeding fluid device with an extension hose that is to be connected to at least one of the discharge port and the return port, and preferable that a coupler is provided at each of both ends of the extension hose. As a result, if the discharge port and the return port of the feeding fluid device cannot be directly connected to the fluid-pressure closed circuit, it is possible to be connected to the fluid-pressure closed circuit through the extension hose.

In accordance with the present invention, the hydraulic fluid is filled in the fluid-pressure closed circuit in a pressurized manner, and no fluid-pressure pump for pressurizing and feeding the hydraulic fluid is provided. As a result, it is possible to achieve a simple and inexpensive die cushion device as well as possible to save power costs required for the die cushion operation.

DETAILED DESCRIPTION OF THE EMBODIMENTS

With reference to accompanying drawings, embodiments of a die cushion device in accordance with the present invention will be described in detail.

(Configuration of the Die Cushion Device)

Figure 1:
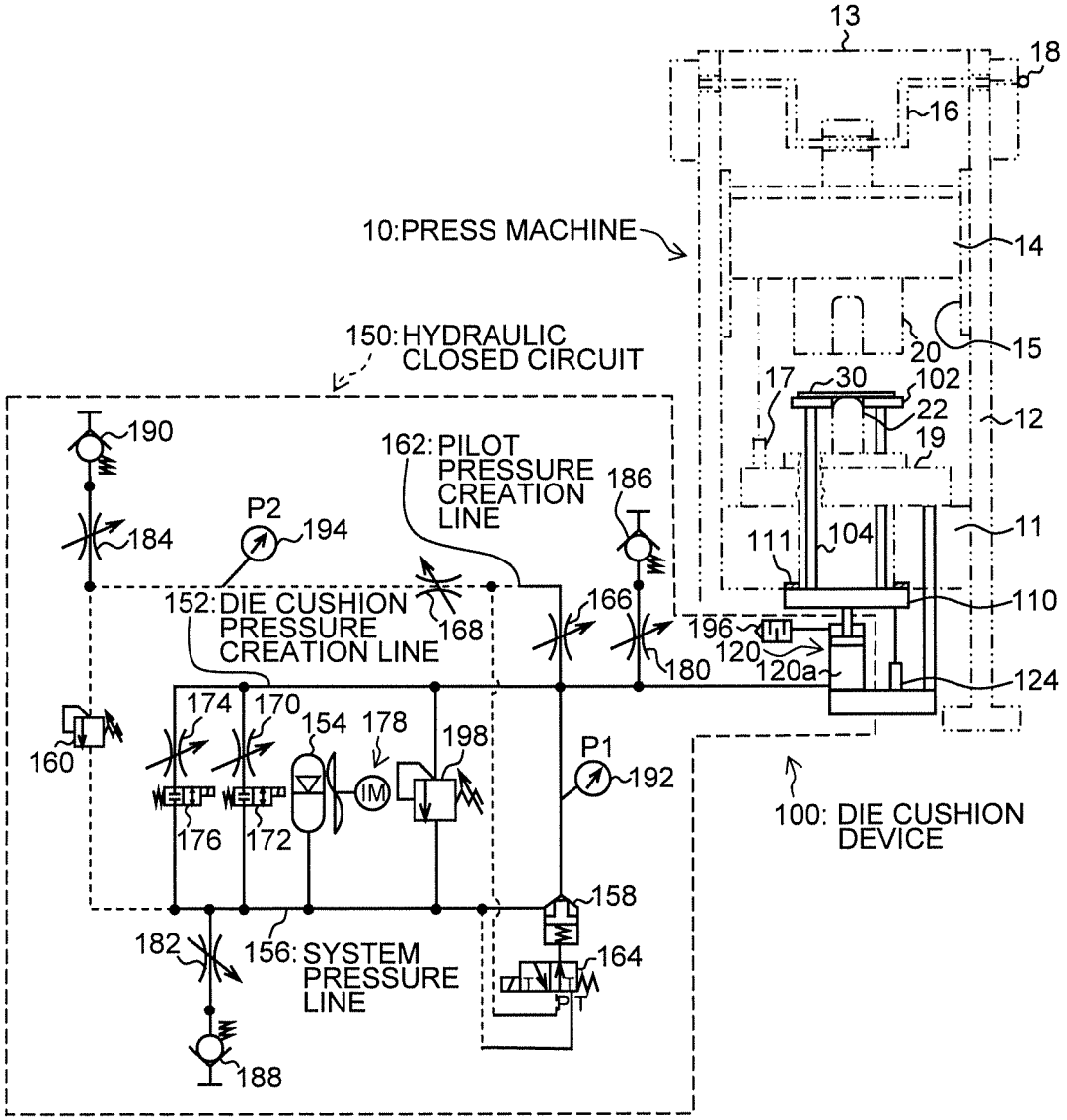
FIG. 1 is a constitution diagram illustrating an embodiment of a die cushion device in accordance with the present invention.

FIG. 1 is a constitution diagram illustrating an embodiment of a die cushion device in accordance with the present invention. In FIG. 1, a press machine 10 is illustrated with two-dot chain lines and a die cushion device 100 is illustrated with solid lines.

The press machine 10 illustrated in FIG. 1 includes a frame that is composed of a bed 11, a column 12, and a crown 13, and a slide 14 that is movably guided in a vertical direction by a guide section 15 provided in the column 12. The slide 14 is moved in the vertical direction in FIG. 1 by a servo motor (not illustrated), or a crank mechanism including crankshaft 16 to which rotational driving force is transmitted by a flywheel (not illustrated).

It is preferable that the press machine 10 is provided on its bed 11 side with a slide position detector 17 that detects a position of the slide 14, or that the crankshaft 16 is provided with a crankshaft encoder 18 that detects an angle of the crankshaft 16.

An upper mold 20 is mounted in the slide 14, and a lower mold 22 is mounted on a bolster 19 of the bed 11.

A blank holder (blank holding plate) 102 is arranged in a space between the upper mold 20 and the lower mold 22 so that a lower side thereof is supported by a cushion pad 110 through a plurality of cushion pins 104 and a material 30 is set on (brought into contact with) an upper side thereof.

(Structure of the Die Cushion Device)

The die cushion device 100 includes the blank holder 102, the cushion pad 110 that supports the blank holder 102 through the plurality of cushion pins 104, a hydraulic cylinder (fluid-pressure cylinder) 120 that supports the cushion pad 110 to allow the cushion pad 110 to apply die cushion force, and a hydraulic closed circuit (fluid-pressure closed circuit) 150 that is connected to a die cushion pressure creation chamber 120*a* of the hydraulic cylinder 120.

The hydraulic cylinder 120 and the hydraulic closed circuit 150 serve as a cushion pad lifting unit that allows the cushion pad 110 to perform lifting operation, as well as serve as a die cushion force creation unit that allows the cushion pad 110 to apply die cushion force.

In addition, the hydraulic cylinder 120 is provided with a die cushion position detector 124 that detects a position of a piston rod of the hydraulic cylinder 120 in an extending direction thereof as a position of the cushion pad 110 in a lifting direction thereof. The die cushion position detector 124 may be provided in a space between the bed 11 and the cushion pad 110.

Next, a configuration of the hydraulic closed circuit 150 that drives the hydraulic cylinder 120 will be described.

The hydraulic closed circuit 150 includes: a die cushion pressure creation line 152 that is connected to the die cushion pressure creation chamber 120*a* of the hydraulic cylinder 120; a system pressure line 156 to which an accumulator 154 that accumulates hydraulic oil (operating oil, hydraulic fluid, operating fluid) at low system pressure is connected; a pilot drive type logic valve 158 that is provided in a line between the die cushion pressure creation line 152 and the system pressure line 156, and that is operable as a main relief valve at the time of die cushion operation; and a pilot relief valve 160 that is provided in a line between the die cushion pressure creation line 152 and the system pressure line 156, and that creates pilot pressure for controlling the logic valve 158. At this time, it is preferable that the logic valve 158 and the pilot relief valve 160 are a direct drive type in which there is little leak (no leak).

System pressure in the system pressure line 156, to which the accumulator 154 is connected, is required to be equal to or more than a pressure that is at least capable of raising the cushion pad 110, capable of knockout operation for a product, and capable of moving the cushion pad to its standby position. It is preferable that the system pressure is set at a pressure within a range of 1 to 10 MPa, for example.

In addition, the hydraulic closed circuit 150 includes a first solenoid valve 164 that switches pressure to act on a pilot port of the logic valve 158 to any one of the pilot pressure created in the pilot pressure creation line 162 and the system pressure created in the system pressure line 156. In the pilot pressure creation line 162, throttle valves (variable throttle valves) 166 and 168 are provided to regulate a flow rate. In the present example, the throttle valve 168 is fully opened.

Further, in a line between the die cushion pressure creation line 152 and the system pressure line 156, a throttle valve 170 and a second solenoid valve 172, and a throttle valve 174 and a second solenoid valve 176, are provided in parallel. The second solenoid valves 172 and 176 are individually controlled so as to be turned on and off. It is preferable that the second solenoid valves are a poppet type solenoid valve in which there is little leak (no leak) when turned off (fully closed).

The accumulator 154 is provided with a cooling device 178 so that it is possible to cool the accumulator 154 (hydraulic oil) by the cooling device 178. The cooling device 178 may be provided so as to cool the system pressure line 156.

In addition, the die cushion pressure creation line 152, the system pressure line 156, and the pilot pressure creation line 162, include throttle valves (needle valves) 180, 182, and 184, for feeding fluid and filling system pressure, and couplers 186, 188, and 190, respectively.

Further, the die cushion pressure creation line 152 and the pilot pressure creation line 162 include a die cushion pressure detector 192 that detects die cushion pressure and a pilot pressure detector 194 that detects pilot pressure, respectively.

In FIG. 1, a reference numeral 196 designates a silencer, and a reference numeral 198 designates a relief valve serving as a safety valve.

(Oiling Device (Feeding Fluid Device))

Next, an oiling device will be described.

Figure 2:
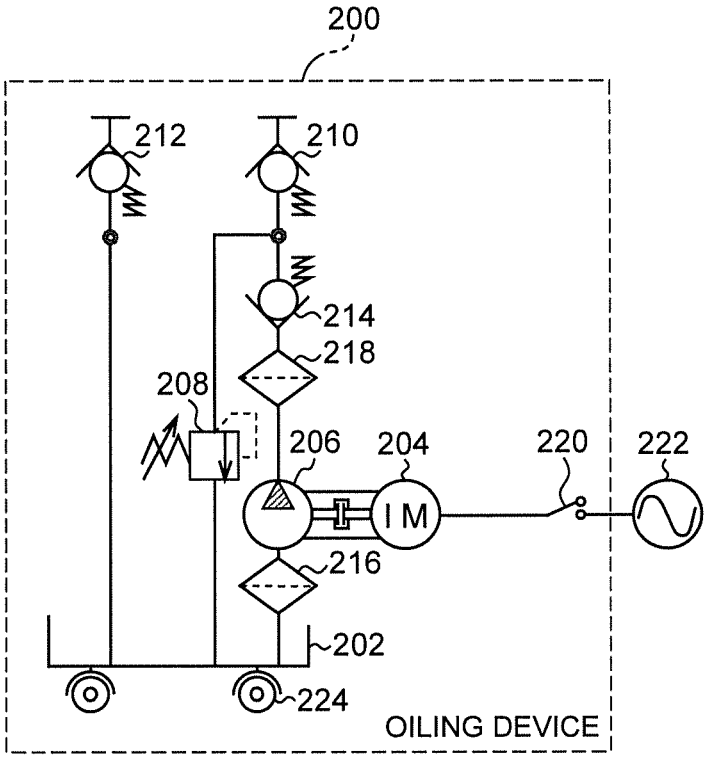
FIG. 2 is a constitution diagram illustrating an embodiment of an oiling device.

FIG. 2 is a constitution diagram illustrating an embodiment of the oiling device.

The oiling device 200 is used when fluid is fed and system pressure is filled, or when system pressure is reduced (at the time of setup preparation), but is not used at the time of a cyclic function (normal function) of the die cushion device 100.

Thus, the oiling device 200 is not required to be accompanied for each of die cushion devices 100, but one feeding fluid device is to be prepared for a plurality of controlled die cushion devices 100. In addition, a user is not required to possess the oiling device, but a service department at a service site may possess the oiling device.

As illustrated in FIG. 2, the oiling device 200 includes a tank 202 that stores hydraulic oil, a hydraulic pump (fluid-pressure pump) 206 that is driven by an induction motor 204, a relief valve 208 that serves as a safety valve, couplers 210 and 212, a check valve 214, and filters 216 and 218.

The two couplers 210 and 212 of the oiling device 200 are connected to any two of the three respective couplers 186, 188, and 190, provided in die cushion pressure creation line 152, the system pressure line 156, and the pilot pressure creation line 162, in the hydraulic closed circuit 150, respectively.

Figure 3:
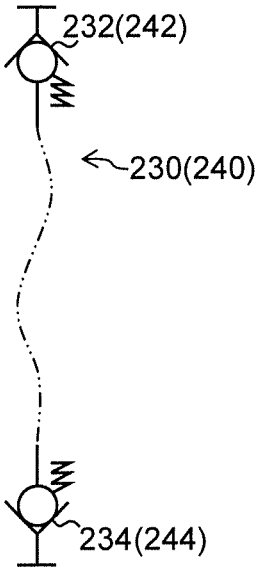
FIG. 3 illustrates an extension hose that connects a hydraulic closed circuit and the oiling device.

In a case where the couplers 210 and 212 of the oiling device 200 cannot be connected to any two of the three respective couplers 186, 188, and 190, of the hydraulic closed circuit 150, the couplers 210 and 212 are connected to any two of them through one extension hose 230 or two extension hoses 230 and 240 illustrated in FIG. 3.

The extension hose 230(240) is provided at its both ends with respective couplers 232(242) and 234(244), so that the coupler 210 or 212 in the oiling device and the coupler 186, 188, or 190 in hydraulic closed circuit can be connected through the couplers.

When a switch 220 is turned on, the induction motor 204 of the oiling device 200 is driven by AC current (alternating-current) from an AC (alternating-current) power source 222 to operate the hydraulic pump 206. Accordingly, it is possible to feed hydraulic oil in the tank 202 to the hydraulic closed circuit 150 of the die cushion device 100 through the filters 216 and 218, the check valve 214, and the coupler 210 (or the coupler 210 and the extension hose 230), as well as possible to return the hydraulic oil to the tank 202 from the hydraulic closed circuit 150 through the coupler 212 (or the coupler 212 and the extension hose 230).

In addition, the oiling device 200 is provided in its lower surface with casters 224 to be easily movable.

(Preparation and Setup (Filling Hydraulic Oil into the Hydraulic Closed Circuit in a Pressurized Manner))

When the die cushion device 100 of the present example is used, it is required to perform preparation and setup operation of filling hydraulic oil into the hydraulic closed circuit 150 in a pressurized manner.

Figure 4:
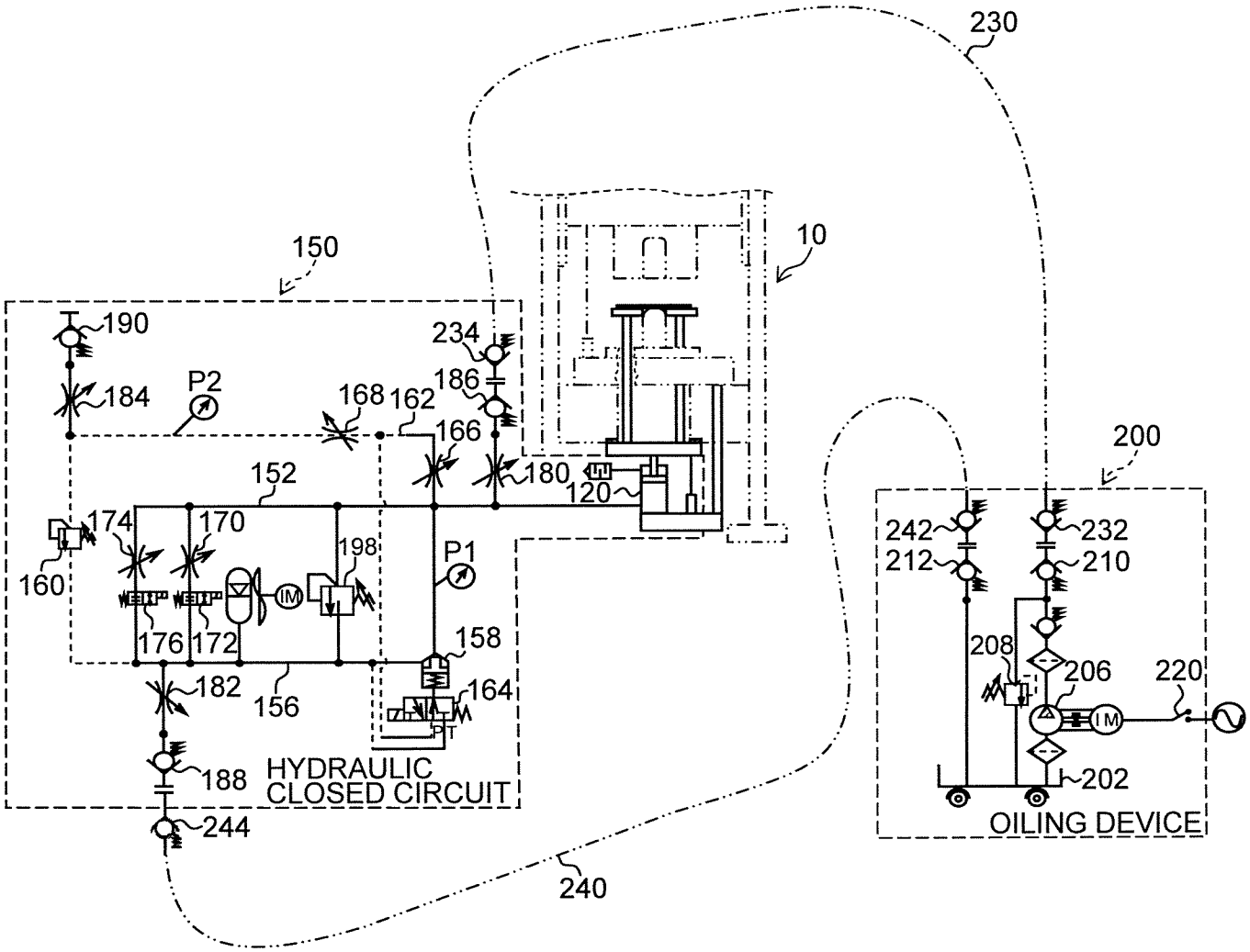
FIG. 4 illustrates a state where the hydraulic closed circuit and the oiling device are connected through the extension hose.

With reference to FIG. 4, a specific example of the preparation and setup operation will be described.

First, the coupler 210 in a discharge port of the oiling device 200 is connected to the coupler 232 at one end of the extension hose 230, and the coupler 234 at another end of the extension hose 230 is connected to the coupler 186 in a connection port in the die cushion pressure creation line 152 in the hydraulic closed circuit 150. In addition, the coupler 212 in a return port of the oiling device 200 is connected to the coupler 242 at one end of the extension hose 240, and the coupler 244 at another end of the extension hose 240 is connected to the coupler 188 in a connection port in the system pressure line 156 in the hydraulic closed circuit 150.

Subsequently, in a state where each of the pilot relief valve 160 and the relief valve 198 is set at a minimum pressure by fully opening the throttle valve 166, 168, 170, 174, 180, 182, and 184, and by turning on the first solenoid valve 164 and the second solenoid valves 172 and 176, the switch 220 of the oiling device 200 is turned on to drive the hydraulic pump 206 by the induction motor 204.

Accordingly, the hydraulic oil in the hydraulic closed circuit 150 and the oiling device 200(tank 202) is circulated to gradually remove air and contaminants in the hydraulic closed circuit 150. In addition, the throttle valve 182 on a return side is throttled to adjust set pressure in the relief valve 208 of the oiling device 200 (so that a certain pressure is applied), and after pressure in the hydraulic closed circuit 150 is accumulated, the throttle valve 182 is opened to circulate the hydraulic oil. As a result, a ratio of air included in the circulating hydraulic oil is increased to improve air-bleeding efficiency. Further, after the hydraulic oil is sufficiently circulated in the connection above, the connection is changed so that the coupler 244 at another end of the extension hose 240 is connected to a coupler 190 in a connection port in the pilot pressure creation line 162 in the hydraulic closed circuit 150 to perform the same processing. It is preferable to repeat the processing above multiple times.

Finally, the throttle valve 184 on the return side is closed to adjust set pressure in the relief valve 208 of the oiling device 200 to the system pressure, and when the pressure in the hydraulic closed circuit 150 is accumulated to the system pressure, the throttle valve 180 on a forward side is closed, and then the switch 220 is turned off to stop the hydraulic pump 206.

After that, setting of each of all of the pilot relief valve 160, the relief valve 198, and the throttle valves 166, 168, 170, and 174 in the hydraulic closed circuit 150 is returned to a predetermined value to finish feeding fluid in the hydraulic closed circuit 150, that is, filling hydraulic oil at system pressure is finished. After feeding fluid (filling system pressure), the couplers 234 and 244 at another ends of the extension hoses 230 and 240 are separated from the couplers 186 and 188 in the hydraulic closed circuit 150, respectively.

(Die Cushion Pressure Control)

Next, die cushion pressure control by the logic valve 158 and the pilot relief valve 160 will be described.

In FIG. 1, in a state where hydraulic oil is filled in the hydraulic closed circuit 150 in a pressurized manner, the press machine 10 is operated so that when the slide 14 descends to allow the upper mold 20 attached to the slide 14 to impact (collide) the material 30 on the blank holder 102, the cushion pad 110 after the impact descends in synchronization with the slide 14. Then, power of the slide 14 creates pressure in the die cushion pressure creation chamber 120*a* of the hydraulic cylinder 120 through the upper mold 20, the material 30, the blank holder 102, the cushion pin 104, and the cushion pad 110. The pressure (die cushion pressure) is controlled by the logic valve 158 and the pilot relief valve 160.

Figure 5:
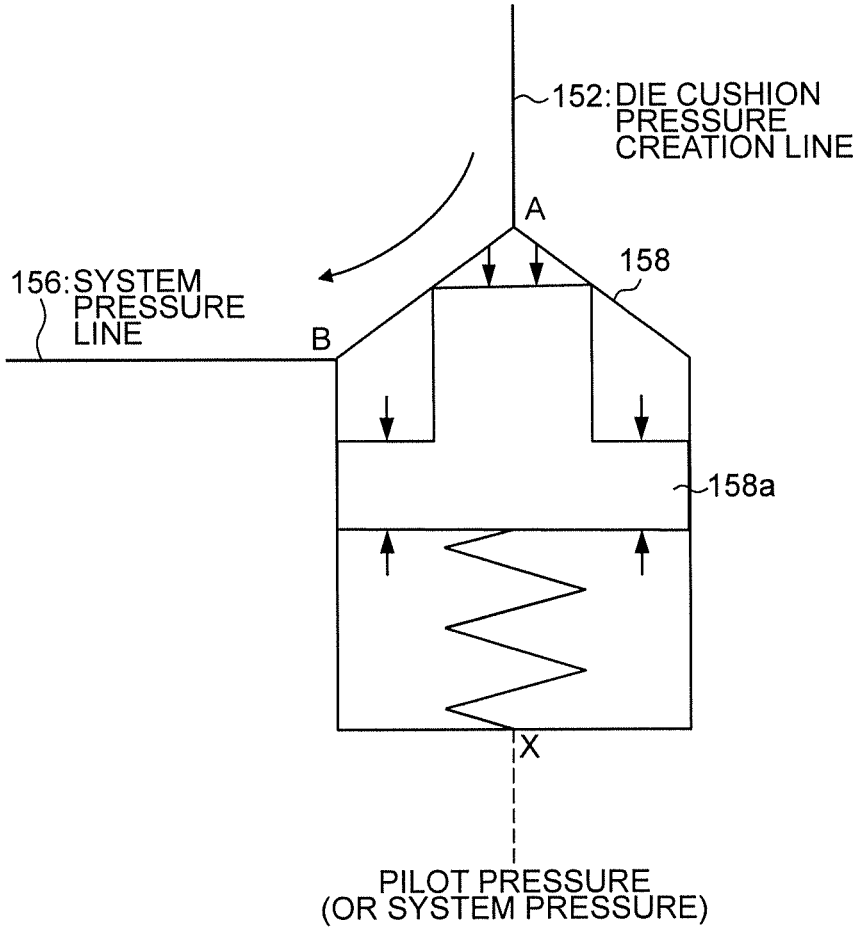
FIG. 5 is an enlarged view of a logic valve illustrated in FIG. 1.

FIG. 5 is an enlarged view of the logic valve 158 illustrated in FIG. 1. In FIG. 5, the logic valve 158 is provided with an A port and a B port to which the die cushion pressure creation line 152 and the system pressure line 156 are connected, respectively so that the die cushion pressure and the system pressure are applied to the A port and the B port, respectively. In addition, the logic valve 158 is provided with a pilot port (X port) to which the pilot pressure or the system pressure is to be applied by turning on and off the first solenoid valve 164.

Hereinafter, area, pressure, and spring force of each of the ports of the logic valve 158 are designated by reference characters below.

$A_A$: pressurized area on an A port side
$A_B$: pressurized area on a B port side
$A_X$: pressurized area on an X port side
$P_A$: A port pressure (die cushion pressure)
$P_B$: B port pressure (system pressure)
$P_X$: X port pressure (pilot pressure)
F: spring force In a case where Expression 1 shown below is satisfied, depressing force toward the X port side is applied to a poppet 158*a* of the logic valve 158 to open the valve, and in a case where Expression 2 is satisfied, depressing force toward the A port side is applied to the poppet 158*a* of the logic valve 158 to close the valve.

$$A_A \times P_A + A_B \times P_B > A_X \times P_X + F \quad \text{Expression 1}$$

$$A_A \times P_A + A_B \times P_B < A_X \times P_X + F \quad \text{Expression 2}$$

In Expression 1 and Expression 2, since $A_A$, $A_B$, $A_X$, $P_B$, and F are constant, the logic valve 158 is opened and closed in accordance with balance between the die cushion pressure (A port pressure) $P_A$ and the pilot pressure (X port pressure) $P_X$.

Since the pilot pressure $P_X$ is adjustable by means of pressure setting in the pilot relief valve 160, the logic valve 158 can adjust the die cushion pressure in accordance with the pilot pressure (relief pressure) set in the pilot relief valve 160.

(Controller)

Figure 6:
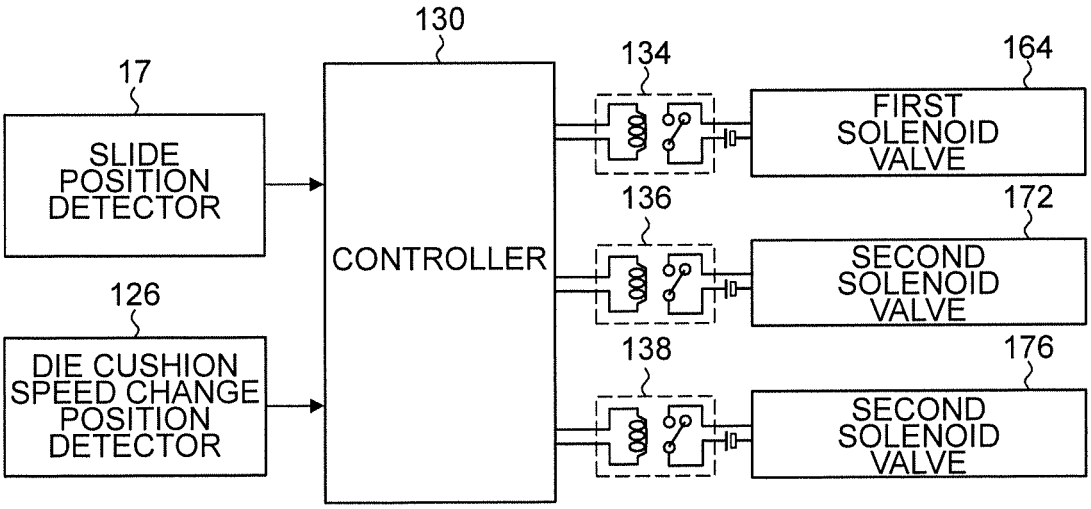
FIG. 6 is a block diagram illustrating an embodiment of a controller applied to the die cushion device.

FIG. 6 is a block diagram illustrating an embodiment of a controller 130 applied to the die cushion device 100.

The controller 130 illustrated in FIG. 6 controls turning on and off of the first solenoid valve 164 and the second solenoid valves 172 and 176 of the hydraulic closed circuit 150 illustrated in FIG. 1. The controller 130 controls turning on and off of relays 134, 136, and 138 in response to a signal of a position of the slide 14 detected by the slide position detector 17 and a signal of a die cushion speed change position detected by a die cushion speed change position detector 126, and outputs a driving current to the first solenoid valve 164 and the second solenoid valves 172 and 176 through the relays 134, 136, and 138, whose turning on and off is controlled. As a result, the controller 130 individually controls turning on and off of the first solenoid valve 164 and the second solenoid valves 172 and 176. The die cushion speed change position detector 126 detects a die cushion position (die cushion speed change position) at which a rising speed of the cushion pad 110 is changed, while the cushion pad 110 is rising. It is possible to use a proximity switch, a limit switch or the like that can be provided so that a desired die cushion speed change position is detected.

The controller 130 of the present example performs a simple control in which turning on and off of the first solenoid valve 164 and the second solenoid valves 172 and 176 are individually controlled, so that no special control device is required, and a part of a controller of the press machine 10 (programmable logic controller (PLC)) is available for the turning on and off of the first solenoid valve 164 and the second solenoid valves 172 and 176. Thus, cost of the die cushion device 100 does not increase.

Specific timing of controlling turning on and off of the first solenoid valve 164 and the second solenoid valves 172 and 176 by the controller 130 will be described later. The controller 130 may control turning on and off of the first solenoid valve 164 and the second solenoid valves 172 and 176 in response to an angle of the crankshaft 16 detected by the crankshaft encoder 18.

(Cyclic Function (Normal Mechanism) of the Die Cushion Device)

Next, each function in one cycle in a case where the die cushion device 100 illustrated in FIG. 1 is used will be described.

Figure 7:
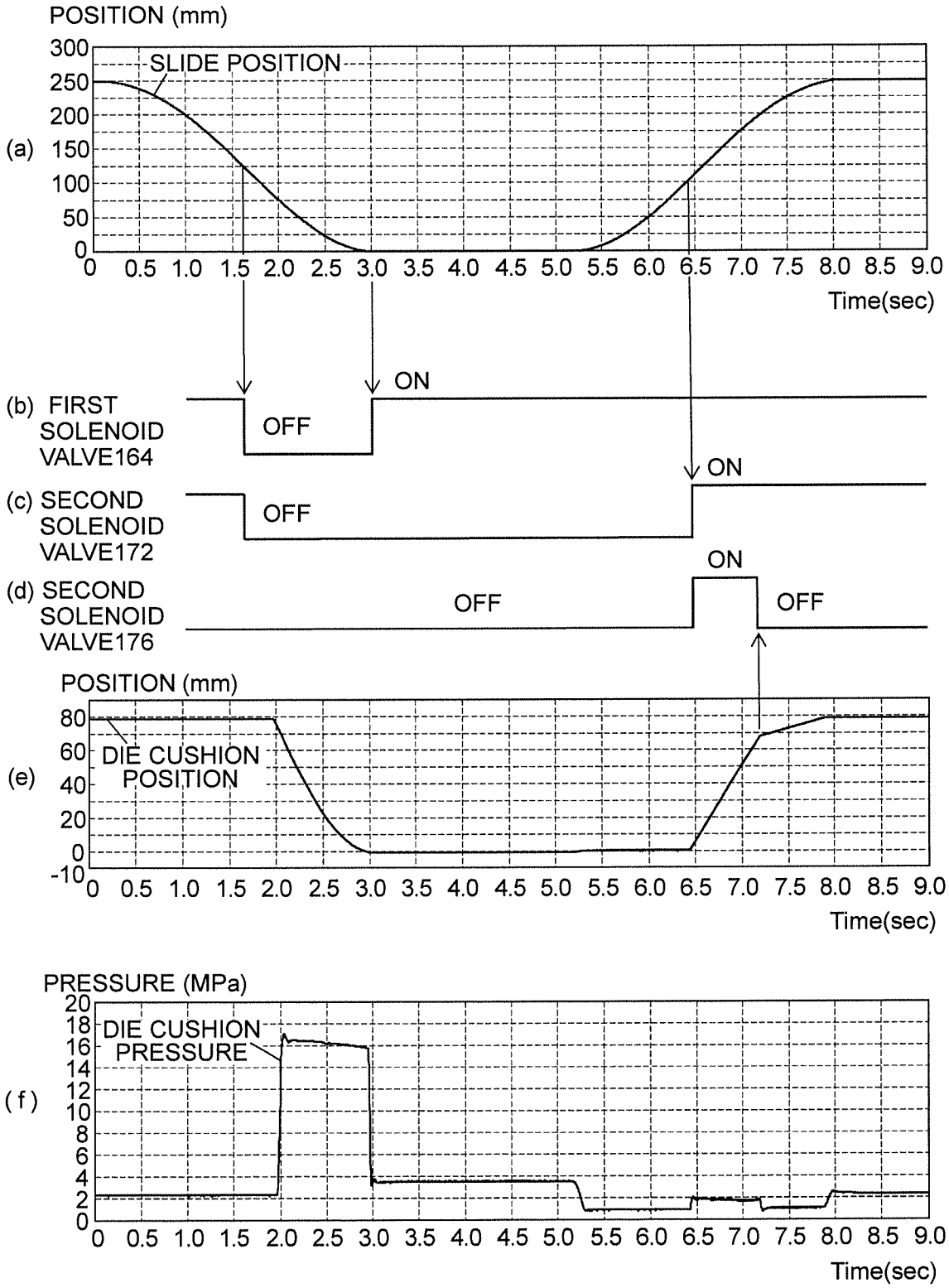
FIG. 7 is a diagram illustrating ON/OFF control of a first solenoid valve and a second solenoid valve.

Portion (a) in FIG. 7 is a waveform chart illustrating a slide position of the slide 14 in one cycle period (0.0 to 9.0 seconds) of pressing. Each of portions (b) to (d) in FIG. 7 is a timing chart illustrating timing of controlling turning on and off of the first solenoid valve 164 and the second solenoid valves 172 and 176. Each of portions (e) and (f) in FIG. 7 is a waveform chart illustrating a position (die cushion position) of the cushion pad 110 and die cushion pressure in one cycle.

Figure 8A:
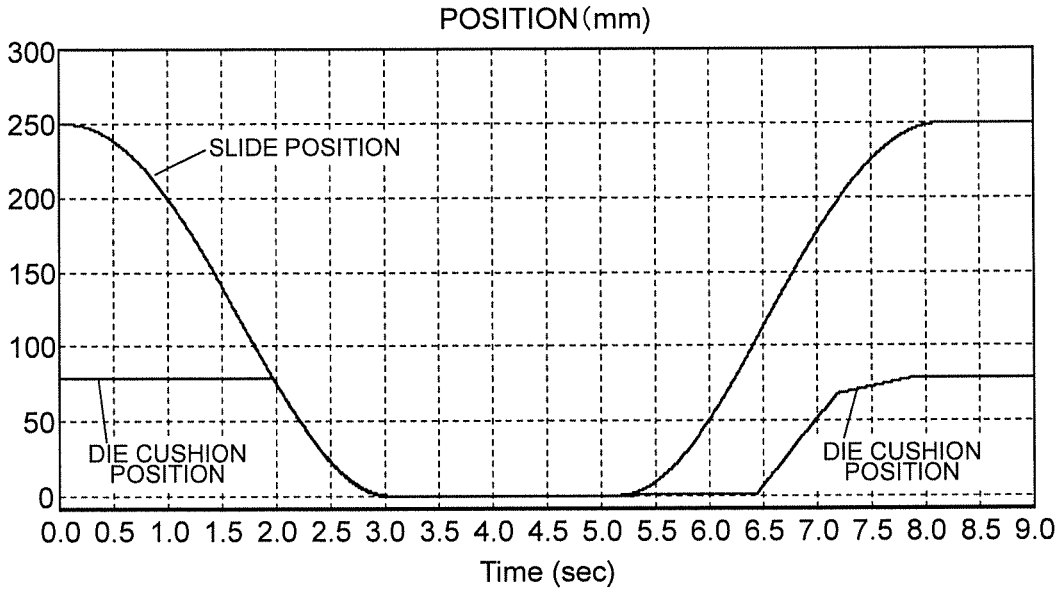
FIG. 8A is a waveform chart illustrating a slide position of a slide and a cushion pad position (die cushion position) in one cycle period.
Figure 8B:
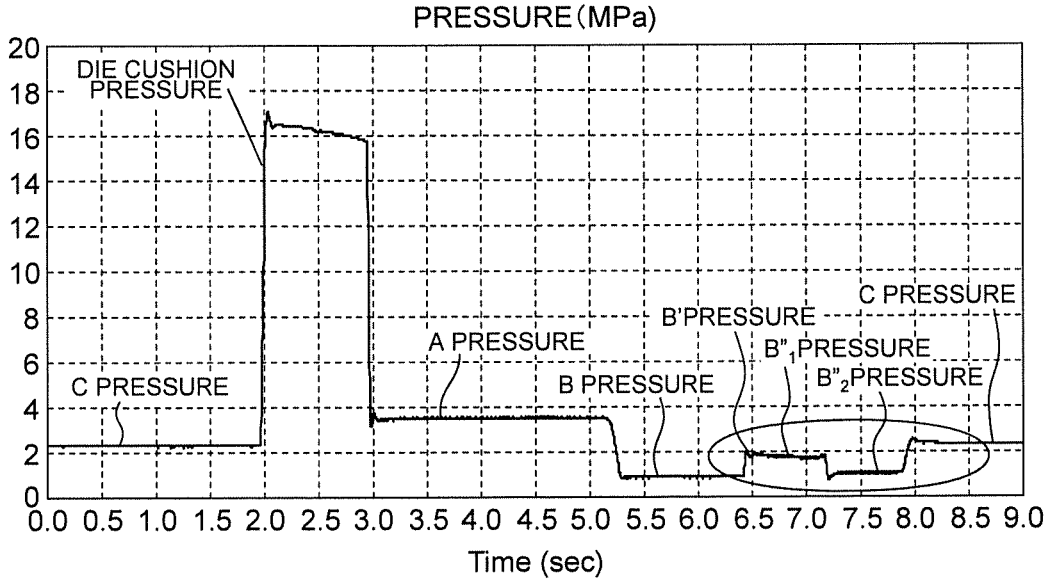
FIG. 8B is a waveform chart illustrating die cushion pressure in the one cycle period.

In addition, FIG. 8A is a waveform chart illustrating a slide position and a die cushion position in one cycle period of pressing, and FIG. 8B is a waveform chart illustrating die cushion pressure in the one cycle period.

(1) Standby Process

The controller 130 turns on each of the first solenoid valve 164 and the second solenoid valve 172, and turns off the second solenoid valve 176, at least when the slide 14 is positioned at the top dead center, so that the die cushion pressure creation line 152 and the system pressure line 156 have the same pressure. Accordingly, the system pressure acts in the die cushion pressure creation chamber 120*a* of the hydraulic cylinder 120 so that the hydraulic cylinder 120 rises and the cushion pad 110 is brought into contact with an upper limit stopper 111 of the bed 11 to stop (stand by) (the upper limit stopper 111 receives reaction force against rising force acting on the hydraulic cylinder 120).

(2) Impact and Die Cushion Force Acting Process

Before the slide 14 of the press machine 10 impacts the cushion pad 110 through the upper mold 20, the material 30, the blank holder 102, and the cushion pin 104 after starting descending (a position near a half of a stroke on a descending side (a crank angle of approximately 90 degrees)), the controller 130 turns off the first solenoid valve 164 and the second solenoid valve 172 (refer to portions (b) and (c) in FIG. 7). In that state, when the slide 14 impacts the cushion pad 110, die cushion pressure in proportion to die cushion force is created in the die cushion pressure creation chamber 120*a* of the hydraulic cylinder 120 by means of synergism of the logic valve 158, the throttle valve 166 (throttle valve 168), and the pilot relief valve 160 (refer to portion (f) in FIG. 7 and FIG. 8B). That is, a hydraulic flow (a flow rate of hydraulic oil flowing per unit time) occurs because the die cushion pressure applied from the die cushion pressure creation line 152 to the system pressure line 156 is applied through the throttle valve 166, the throttle valve 168, the pilot relief valve 160, in order. Accordingly, the pilot pressure less than the die cushion pressure is created between the throttle valve 166 and the throttle valve 168 (the pilot pressure creation line 162). As a result, pressure acts on the poppet of the logic valve 158 to keep balance of force as follows: the die cushion pressure acts mainly on pressurized area of a die cushion pressure acting side; the system pressure acts on pressurized area of a system pressure acting side; the pilot pressure acts on pressurized area of a pilot pressure acting side (pressurized area of an X port side) through the first solenoid valve 164; spring force acts on the poppet inside the logic valve; and fluid force acts on the logic valve 158 in a direction interfering with a flow of the hydraulic oil from the die cushion pressure creation line 152 to the system pressure line 156 (closing the valve). Thus, a poppet position (opening) of the logic valve 158 is held in accordance with speed of the slide 14 (held almost constant if the speed is constant), and the die cushion pressure is created during a series of actions.

Reduction in surge pressure, and steadiness (constancy) of pressure with respect to change in slide speed, at the time of the impact (at the time of starting a die cushion action) are feasible by a method that is not shown in the present example.

If the die cushion pressure detector 192 and a pressure gauge are provided in the die cushion pressure creation line 152 to check the die cushion pressure, operation of a user becomes easier.

In addition, a solenoid proportion pilot relief valve is used as the pilot relief valve 160, so that it is possible to remotely set the die cushion force (or the die cushion pressure) by using a setting controller or the like.

Further, the solenoid proportion pilot relief valve is used as the pilot relief valve 160, so that it is also possible to control the die cushion pressure in a constant manner or in a variable manner.

Figure 9:
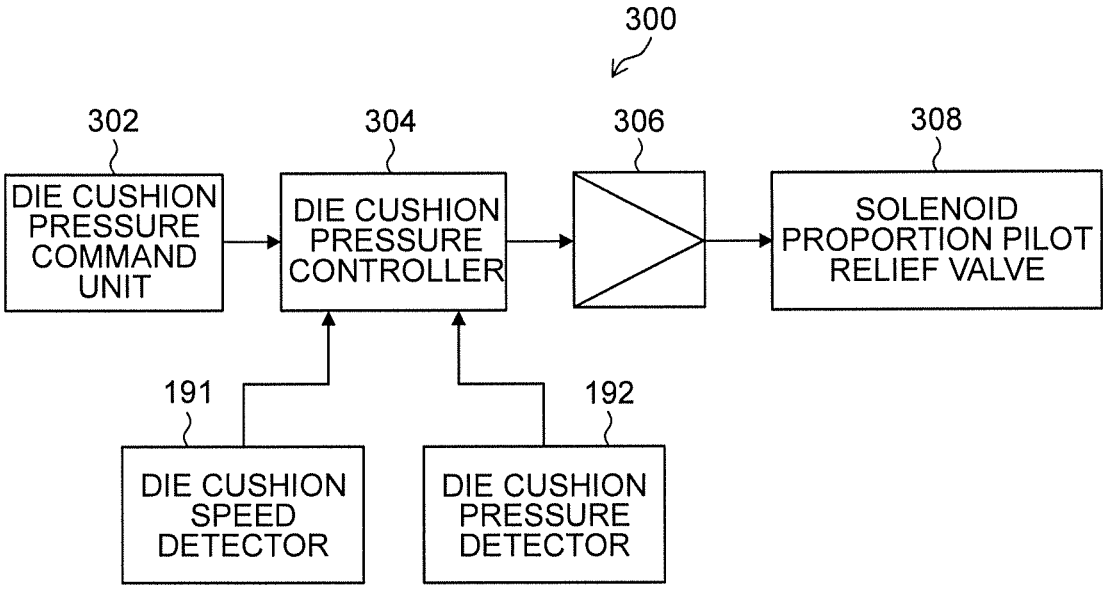
FIG. 9 is a block diagram illustrating a die cushion pressure control unit that controls die cushion pressure by using a solenoid proportion pilot relief valve.

FIG. 9 is a block diagram illustrating a die cushion pressure control unit that controls die cushion pressure by using a solenoid proportion pilot relief valve, and a solenoid proportion pilot relief valve 308 is used as the pilot relief valve 160.

As illustrated in FIG. 9, a die cushion pressure control unit 300 includes a die cushion pressure command unit 302, a die cushion pressure controller 304, the solenoid proportion pilot relief valve 308 provided instead of the pilot relief valve 160 illustrated in FIG. 1, a die cushion speed detector 191, and a die cushion pressure detector 192 provided in the die cushion pressure creation line 152. The die cushion speed detector 191 detects a speed (die cushion speed) of the cushion pad 110 that almost coincides with a slide speed calculated by an encoder provided in the crankshaft 16 to detect a crank angle and a crank angular speed after the impact. The die cushion speed detector 191 may detect the die cushion speed by differentiating a die cushion position detected by the die cushion position detector 124.

The die cushion pressure command unit 302 creates a command value showing die cushion pressure that varies stepwise or continuously, on the basis of constant die cushion pressure, a die cushion position of the cushion pad 110 detected by the die cushion position detector 124, or the like, for example, and outputs the created command value to the die cushion pressure controller 304.

Other inputs to the die cushion pressure controller 304 include a speed detection signal (die cushion speed detection value) of the cushion pad 110 detected by the die cushion speed detector 191, and a detection value of die cushion pressure that is created in the die cushion pressure creation line 152, detected by die cushion pressure detector 192. The die cushion pressure controller 304 creates a control signal of remotely operating setting of pressure of the solenoid proportion pilot relief valve 308 on the basis of die cushion pressure command value, the detection value of die cushion speed, and the detection value of die cushion pressure, through control algorithm calculation in which the detection value of die cushion pressure follows the die cushion pressure command value. Then, the die cushion pressure controller 304 outputs the created control signal to the solenoid proportion pilot relief valve 308 through an amplifier 306. The die cushion speed is used to compensate a response lag of the solenoid proportion pilot relief valve 308 with respect to the pressure command. In the present embodiment, although the detection value of die cushion speed (a speed detection value of the cushion pad) and the detection value of die cushion pressure are used together, only the speed detection value of the cushion pad may be used for controlling compensation because it is most effective to use the speed detection value of the cushion pad for controlling compensation.

Accordingly, it is possible to allow the die cushion pressure created in the die cushion pressure creation line 152 to follow a command value of die cushion pressure outputted from the die cushion pressure command unit 302, as well as possible to control the die cushion pressure at a constant pressure regardless of a speed of the slide 14 at the time of the die cushion operation, and to vary the die cushion pressure in accordance with a position of the slide 14.

(3) Removing Pressure Process

The controller 130 turns on the first solenoid valve 164 when the slide 14 of the press machine 10 descends to reach the bottom dead center or slightly in front of the bottom dead center (near the bottom dead center) (refer to portion (b) in FIG. 7). Accordingly, the poppet of the logic valve 158 moves in an opening direction (because the pilot pressure acting in a direction of closing the poppet (in pressurized area on a pilot pressure acting side) is released into the system pressure line 156) so that the die cushion pressure is removed.

The die cushion pressure at this time decreases to a pressure (pressure A illustrated in FIG. 8B) equal to or close to a sum total of the system pressure that acts in the system pressure line 156, and that rises as compared with the pressure in a standby state because the hydraulic cylinder 120 descends to push away oil from the die cushion pressure creation chamber 120*a* so that the amount of the oil is accumulated in the accumulator 154, and of cracking pressure corresponding to spring force of the logic valve 158. When removal of the pressure is finished, the poppet of the logic valve 158 is closed.

(4) Locking Process

After the removing pressure process, when the slide 14 of the press machine 10 rises from the bottom dead center, the die cushion pressure decreases to a pressure (pressure B illustrated in FIG. 8B) that is created by means of gravity acting on total mass of movable parts, such as the blank holder 102, the cushion pin 104, the cushion pad 110, and a piston rod of the hydraulic cylinder 120, from the pressure (pressure A) equal to the sum total of the system pressure and the cracking pressure. At this time (during a process in which the pressure decreases to the pressure B from the pressure A), hydraulic oil for a compressed volume in the die cushion pressure creation chamber 120*a* of the hydraulic cylinder 120 is released so that the cushion pad 110 slightly rises. After that (after slightly rising), the die cushion pressure creation line 152 and the system pressure line 156 are shut off by the logic valve 158 and the second solenoid valves 172 and 176, so that the cushion pad 110 is locked near the bottom dead center.

Figure 10:
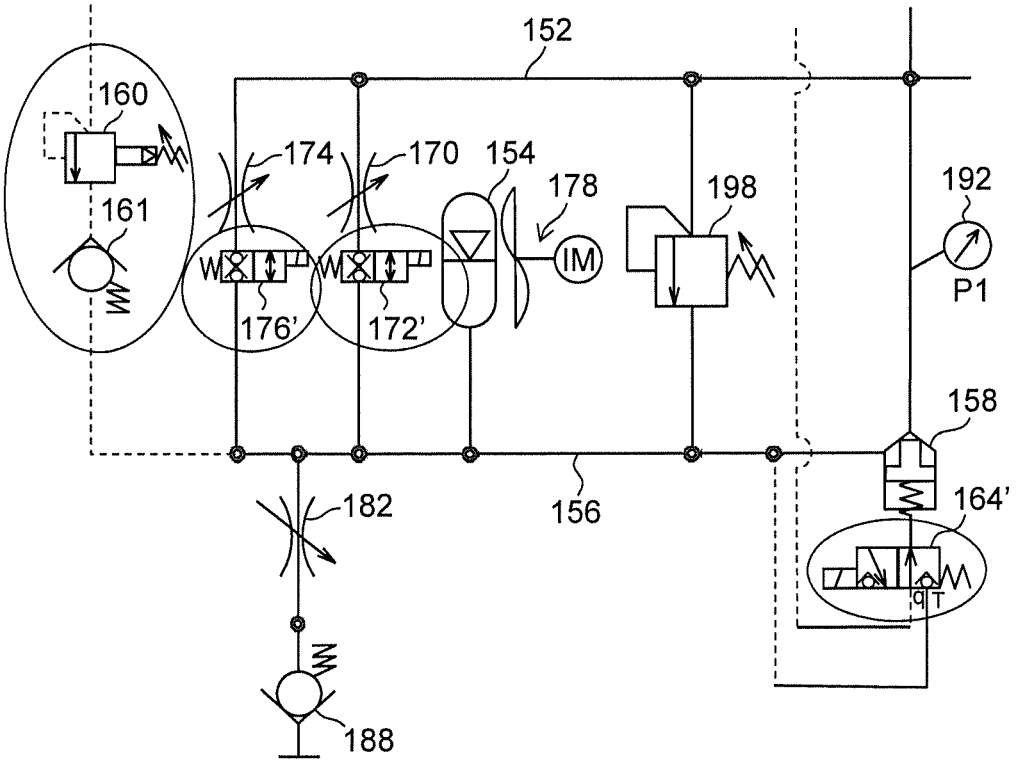
FIG. 10 illustrates a main section of a variation of a hydraulic closed circuit.

At this time, it is preferable that a direct drive type in which there is little leak (no leak) is used as the pilot relief valve 160, and poppet type solenoid valves 164', 172', and 176', in which there is little leak (no leak) are used for the first solenoid valve 164 and the second solenoid valves 172 and 176, respectively, as illustrated in FIG. 10. In a case where a balance piston type (pilot operation type) is used as the pilot relief valve 160, as illustrated in FIG. 10, there is also a method in which a check valve 161 is provided in a direction shown in FIG. 10 to prevent a leak.

(5) Rising (Knockout) Process

In the locking process, when the slide 14 reaches a position near a half of a stroke on a rising side (a crank angle of approximately 270 degrees) after locking for a predetermined period, the controller 130 simultaneously turns on the second solenoid valves 172 and 176 (refer to portions (c) and (d) in FIG. 7). Accordingly, the cushion pad 110 rapidly rises (refer to portion (e) in FIG. 7). In the rising process (knockout process), the controller 130 turns off one of second solenoid valves (the second solenoid valve 176 in the present example). Accordingly, the cushion pad 110 slowly rises (slow down), and finally reaches the upper limit stopper 111 to stop. During the rising process, the second solenoid valve 176 is turned off when the die cushion speed change position detector 126 detects a die cushion speed change position.

Figure 11:
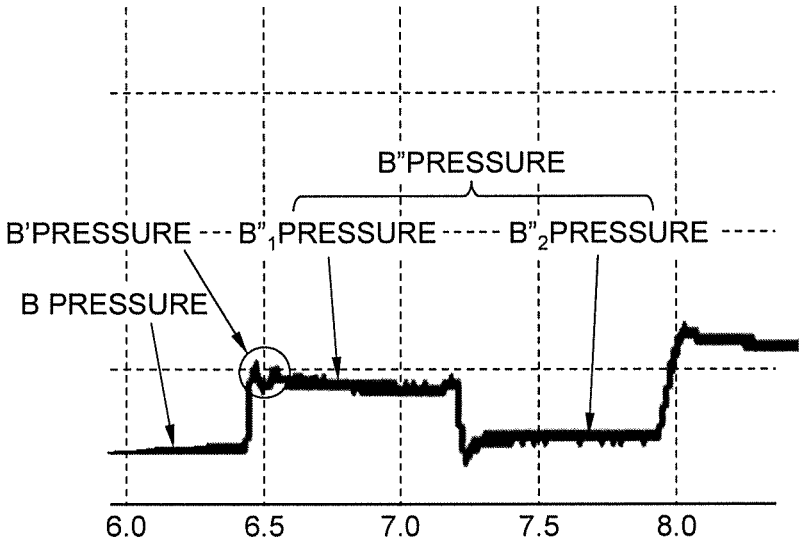
FIG. 11 is an enlarged view of a main section of the waveform chart illustrated in FIG. 8B to illustrate the die cushion pressure.

FIG. 11 is an enlarged view of a main section (the rising process of the cushion pad 110) of the waveform chart shown in FIG. 8B to illustrate the die cushion pressure.

When gaps (openings) created by the throttle valves 170 and 174 occur between the system pressure line 156 on which the system pressure (pressure C) acts and the die cushion pressure creation line 152 on which the pressure B acts during locking, a hydraulic flow (a flow of hydraulic oil) from the system pressure line 156 to the die cushion pressure creation line 152 occurs in accordance with a throttled condition of the gaps (openings) and a differential pressure (pressure (C−B): pressure C>pressure B). As a result, in a process of pressurizing the die cushion pressure creation chamber 120*a* of the hydraulic cylinder 120, positioned near the bottom dead center of the press, at the time (a time of 6.4 seconds) when pressure reaches pressure B' more than the pressure B (refer to FIG. 11), the hydraulic cylinder 120 starts rising.

As volume of the die cushion pressure creation chamber 120*a* increases with rising of the hydraulic cylinder 120, pressure in the die cushion pressure creation chamber 120*a* decreases. The hydraulic cylinder 120 reaches a steady speed Vc ($Vc_1$ in a rapid rising process, and $Vc_2$ in a slow rising process) after exceeding an acceleration range with starting rising of the hydraulic cylinder 120, and the steady speed Vc is determined so that driving pressure of the hydraulic cylinder 120 (pressure B" illustrated in FIG. 11 ($B"_1$ in the rapid rising process, and $B"_2$ in the slow rising process)) reached the steady speed Vc acting on the die cushion pressure creation chamber 120*a* is balanced with a property I determined by resistance force depending on the steady speed Vc, and a property II in which a flow rate in proportion to the steady speed Vc is determined by a differential pressure (the pressure C−pressure B") between pressure in the system pressure line 156 and that in the die cushion pressure creation line 152, and an opening of a gap. In order to increase the steady speed Vc, the pressure B" is required to increase, and as the pressure B" increases, a flow rate of fluid flowing through a gap between the lines, in proportion to the steady speed Vc, decreases. Thus, the steady speed Vc at the time when the cushion pad 110 rises is determined so that the two properties I and II are balanced with each other.

In the beginning of the rising, both of the second solenoid valves 172 and 176 are turned on to perform a rapid rising of the cushion pad 110 in accordance with both openings of the throttle valves 170 and 174, and in the rising process, only the second solenoid valve 172 is turned on to perform a slow rising of the cushion pad 110 in accordance with the opening of the throttle valve 170.

In the rising process, a device that changes an opening by switching the two second solenoid valves 172 and 176 is only an example of the speed change device that varies a rising speed of the cushion pad 110. For the speed change device in a broad sense, any device that can change an opening between the system pressure line 156 and the die cushion pressure creation line 152 in a rising stroke of the hydraulic cylinder 120 is available. For example, more solenoid valves (second solenoid valves) may be provided in parallel to stepwise vary openings of the second solenoid valves, or a proportional solenoid valve may be used for the second solenoid valve to steplessly (continuously) change an opening.

In order that the controller 130 determines timing of changing openings of the second solenoid valves 172 and 176, it is possible to use a position detection signal of the die cushion position detector 124 capable of detecting a position of a full stroke of the cushion pad 110, and possible to use a detection signal of a proximity switch or a limit switch, capable of being fixed at any position in the stroke, or capable of being provided in a variable and adjustable manner.

That is, detection of a slide position (or a crank angle) of the press machine is not an absolute requirement for controlling the die cushion, but it is required to detect at least timing of controlling turning on and off of the first solenoid valve 164 and the second solenoid valves 172 and 176. For example, if there are provided a limit switch (LS1) for detecting the top dead center of the slide 14, a limit switch (LS2) for detecting a position near a half of the stroke on the descending side (a crank angle of approximately 90 degrees) of the slide 14, a limit switch (LS3) for detecting a bottom dead center (crank angle 180 degrees) of the slide 14, and a limit switch (LS4) for detecting a position near a half of the stroke on the rising side (a crank angle of approximately 270 degrees) of the slide 14, it is possible to control turning on and off of the first solenoid valve 164 and the second solenoid valves 172 and 176 on the basis of detection signals of the limit switches (LS1 to LS4).

In addition, in the rising process, if all openings between the system pressure line 156 and the die cushion pressure creation line 152 are shut off, it is also possible to stop the cushion pad 110 in the middle of the stroke for a purpose of feeding a product by a robot, and the like.

Further, if a proportional solenoid valve (a valve capable of proportionally adjusting an opening, including a servo valve) is used as the second solenoid valve to feed back a position detection signal from the die cushion position detector 124 to the controller 130, it is also possible that the controller 130 (based on closed loop control) performs position control to stop the cushion pad 110 at any stroke position. As a result, it is possible to allow the cushion pad 110 to stand by at any stroke position and start die cushion force operation from the any stroke position.

As described above, since the die cushion device 100 does not use devices consuming electric power, such as a hydraulic pump, it is possible to achieve low cost and energy saving. In addition, the die cushion device 100 is made functional by including high response die cushion pressure control, a locking mechanism at the bottom dead center, and a speed change mechanism at the time of knockout (slow down mechanism having no shock at an upper limit of rising).

(Others)

At the time of the die cushion operation, when hydraulic oil at the die cushion pressure is released into the system pressure by the logic valve 158, the hydraulic oil generates heat due to squeezing action of the hydraulic oil applied by the logic valve 158.

In the present example, as illustrated in FIG. 1, there is provided the cooling device 178 that blows air on the accumulator 154 with a large surface area to cool the accumulator 154 (hydraulic oil). The cooling device 178 is an air-cooled cooling device using a fan, but is not limited to the air-cooled cooling device. Thus, a water-cooled cooling device that cools hydraulic oil by circulating cooling water may be provided. If the die cushion device 100 is less used, it is possible to cool hydraulic oil by only natural heat dissipation without providing a cooling device. As a result, a more inexpensive device can be achieved.

In addition, there is described the present embodiment in which oil is used as hydraulic fluid of the die cushion device, but the hydraulic fluid is not limited to oil. Thus, water or another liquid may be used. That is, there is described a configuration of the embodiment of the present application, in which a hydraulic cylinder and a hydraulic closed circuit are used, but the configuration is not limited to the above. Thus, it is needless to say that a fluid-pressure cylinder and a fluid-pressure closed circuit in which water or another liquid is used are applicable to the present invention. In addition, the die cushion device in accordance with the present invention is applicable to not only a crank press but also to any type of press machine, primarily a mechanical press.

Further, the hydraulic cylinder may be provided not only at one place in the cushion pad as described in the embodiment above, but also at two places of the front and rear of the cushion pad or at four places of the front and rear, and the right and left, of the cushion pad, for example.

Furthermore, the present invention is not limited the examples above, and therefore it is needless to say that various modifications and variations are possible within a range without departing from the essence of the present invention.

What is claimed is:

1. A die cushion device comprising: a cushion pad that supports a blank holder through a plurality of cushion pins; a fluid-pressure cylinder configured to apply die cushion force to the cushion pad and lift the cushion pad; and a fluid-pressure closed circuit, the fluid-pressure closed circuit including: a die cushion pressure creation line connected to a die cushion pressure creation chamber of the fluid-pressure cylinder; a system pressure line to which an accumulator is connected, the accumulator being configured to accumulate hydraulic fluid at low system pressure for knockout operation of the cushion pad; a pilot drive type logic valve that is provided between the die cushion pressure creation line and the system pressure line, and that is operable as a main relief valve at a time of die cushion operation; and a pilot relief valve that is provided between the die cushion pressure creation line and the system pressure line, and that creates pilot pressure that acts on a pilot port of the pilot drive type logic valve to control the pilot drive type logic valve, wherein: when the hydraulic fluid in the die cushion pressure creation chamber of the fluid-pressure cylinder is pressurized due to descent of a slide of a press machine, an opening of the logic valve is controlled by the pilot pressure to create a die cushion pressure in the die cushion pressure creation line, and the die cushion operation is performed by the fluid-pressure cylinder; when the slide of the press machine rises from a bottom dead center, the hydraulic fluid of the system pressure accumulated in the accumulator flows into the die cushion pressure creation chamber of the fluid-pressure cylinder, and the knockout operation is performed by the fluid-pressure cylinder; and the hydraulic fluid is filled in the fluid-pressure closed circuit in a pressurized manner to pressurize the hydraulic fluid in the fluid-pressure closed circuit in one cycle period of the cushion pad by using only die cushion force applied from the cushion pad through the fluid-pressure cylinder, one cycle period of the cushion pad including the die cushion operation and the knockout operation.

2. The die cushion device according to claim 1, further comprising a first solenoid valve that switches pressure to act on the pilot port of the pilot drive type logic valve to any one of the pilot pressure and the system pressure during the one cycle period of the cushion pad.

3. The die cushion device according to claim 2, wherein the first solenoid valve is a poppet type solenoid valve.

4. The die cushion device according to claim 2, wherein a second solenoid valve is provided in a line between the die cushion pressure creation line and the system pressure line.

5. The die cushion device according to claim 4, wherein the second solenoid valve is a poppet type solenoid valve.

6. The die cushion device according to claim 4, further comprising a controller configured to control the first solenoid valve so that the pilot pressure is applied to the pilot port of the pilot drive type logic valve during a descending period of the cushion pad, and configured to control the second solenoid valve so that the second solenoid valve is opened during a rising period of the cushion pad.

7. The die cushion device according to claim 6, wherein a plurality of second solenoid valves is provided in a line between the die cushion pressure creation line and the system pressure line in parallel, and wherein the controller individually controls opening and closing of the plurality of second solenoid valves during the rising period of the cushion pad to control a rising speed of the cushion pad.

8. The die cushion device according to claim 6, wherein the second solenoid valve is a proportional solenoid valve, and wherein the controller controls opening of the proportional solenoid valve during the rising period of the cushion pad to control a rising speed of the cushion pad.

9. The die cushion device according to claim 7, further comprising a die cushion position detector configured to detect a position of the cushion pad, wherein the controller controls the second solenoid valve in accordance with a detection signal indicating a position of the cushion pad, detected by the die cushion position detector during the rising period of the cushion pad.

10. The die cushion device according to claim 1, wherein the pilot relief valve is a solenoid proportion pilot relief valve, and the die cushion device further comprises:

a die cushion pressure command unit that instructs die cushion pressure;

a die cushion speed detector that detects a speed of the cushion pad; and a die cushion pressure controller that controls the solenoid proportion pilot relief valve in accordance with a die cushion pressure command value commanded by the die cushion pressure command unit and a detection value of a speed of the cushion pad, detected by the die cushion speed detector to control the die cushion pressure.

11. The die cushion device according to claim 1, further comprising a cooling device that cools the system pressure line or the accumulator.

12. The die cushion device according to claim 1, further comprising a throttle valve for feeding fluid and filling system pressure in the die cushion pressure creation line, the system pressure line, and a pilot pressure creation line in which the pilot relief valve is provided.

13. The die cushion device according to claim 1, further comprising a throttle valve and a coupler for feeding fluid and filling system pressure in the die cushion pressure creation line, the system pressure line, and a pilot pressure creation line in which the pilot relief valve is provided.

14. The die cushion device according to claim 1, further comprising a feeding fluid device, the feeding fluid device including:

a tank that stores the hydraulic fluid;

a discharge port through which the hydraulic fluid is fed into the fluid-pressure closed circuit;

a return port through which the hydraulic fluid is returned form the fluid-pressure closed circuit, the return port being connected to the tank; and a fluid-pressure pump that supplies the hydraulic fluid from the tank to the fluid-pressure closed circuit through the discharge port, wherein the fluid-pressure pump is driven only when the hydraulic fluid is filled in the fluid-pressure closed circuit in a pressurized manner.

15. The die cushion device according to claim 14, further comprising an extension hose with which the feeding fluid device is accompanied, wherein the extension hose is to be connected to at least one of the discharge port and the return port, and wherein a coupler is provided at each of both ends of the extension hose.

16. The die cushion device according to claim 1, wherein no fluid-pressure pump is provided in the fluid-pressure closed circuit for pressurizing and feeding the hydraulic fluid.

* * * * *